US005653468A

United States Patent [19]

Ostapyk

[11] Patent Number: 5,653,468

[45] Date of Patent: Aug. 5, 1997

[54] STABILIZER BEAM FOR ROLLER BLADING

[76] Inventor: Jason Ostapyk, P.O. Box 8058, Pinecrest P.O., Ottawa, ON, Canada, K2G 3Z2

[21] Appl. No.: 655,554

[22] Filed: May 30, 1996

Related U.S. Application Data

[63] Continuation of Ser. No. 329,486, Oct. 26, 1994, abandoned.

[51] Int. Cl.[6] ..... A63C 3/00

[52] U.S. Cl. ..... 280/809; 135/66; 135/85; 280/826

[58] Field of Search ..... 135/66, 72, 77, 135/78, 85; 280/809, 816, 823, 826

[56] References Cited

U.S. PATENT DOCUMENTS

| | | | |
|---|---|---|---|
| 1,608,238 | 11/1926 | Riefschnider | 280/826 |
| 1,985,726 | 12/1934 | Heldman | 280/826 |
| 2,516,852 | 8/1950 | Burry et al. | 135/72 X |
| 2,707,963 | 5/1955 | Goynes | 135/85 |
| 3,561,782 | 2/1971 | Tyrack | 280/816 |
| 4,023,817 | 5/1977 | Lah et al. | 280/816 |
| 4,288,102 | 9/1981 | Ramer | 280/823 |
| 4,386,794 | 6/1983 | Roberts | 280/826 |
| 4,744,584 | 5/1988 | Monreal | 280/809 X |
| 5,163,710 | 11/1992 | Chirtel et al. | 280/809 |
| 5,236,222 | 8/1993 | Fletcher | 280/809 |
| 5,301,704 | 4/1994 | Brown | 135/78 |
| 5,312,135 | 5/1994 | Karabees | 280/826 |

*Primary Examiner*—Eric D. Culbreth
*Assistant Examiner*—Michael Mar
*Attorney, Agent, or Firm*—Pearne, Gordon, McCoy & Granger LLP

[57] ABSTRACT

A stabilizer beam for a roller blade skater. The beam has a first end which supports a brake pad for stopping the skater. A second end detachably retains an insert for supporting an implement useful for stabilizing the roller blade skater on the roller blades. The implement may be one of another brake pad, a free turning wheel and a hockey stick blade. The invention therefore provides a simple, reliable beam which assists roller blade skaters in stopping reliably in minimum space and provides a beam which promotes stability on roller blades by permitting the user to adapt the beam to his skill and/or activity. A brake pad on each end of the beam is preferred for beginner skaters, a wheel on one end of the pad is preferred for experienced skaters wishing to travel at high speed, while a hockey stick blade is preferred for skaters of any skill level wishing to manipulate a ball or a puck while skating.

11 Claims, 3 Drawing Sheets

STABILIZER BEAM FOR ROLLER BLADING

This is a continuation of application Ser. No. 08/329,486, filed Oct. 26, 1994 now abandoned.

TECHNICAL FIELD

The present invention relates to the sport of skating on roller blades, and in particular to accessories for making the sport more safe and enjoyable.

BACKGROUND OF THE INVENTION

Roller blade skating has become a popular, widely practiced sport. Improvements in engineering and materials have provided roller blade skates which permit skaters to rapidly accelerate to considerable momentum. The only braking facility provided by the skates is a brake pad on a heel of one skate. In order to move the brake pad into frictional engagement with the skating surface, the skater must bend one leg, shift body weight to that leg and thrust the braking leg forward while canting the heel downwards to bring the brake pad into contact with the skating surface. This is an awkward maneurve which is difficult to learn and perform, especially if the skating surface tends to be rough or uneven. Consequently, stopping is difficult and is a factor in the majority of injuries resulting from roller blade skating.

Implements to facilitate stability and improve braking on roller blades have been invented. U.S. Pat. No. 5,236,222 which issued Aug. 17, 1993 to Fletcher describes a roller skate pole device which resembles a ski pole with friction pads affixed to one end. A pair of the poles are intended to be used in a manner similar to ski poles. The disadvantage in poles of this type is that the movements required to roller blade at high speed are not very similar to the movements required for skiing. Furthermore, unless the poles are moved together and dragged behind a skater who assumes a crouched position, the poles provide very little braking capability.

U.S. Pat. No. 5,312,135 issued to Karabees on May 17, 1994. This patent describes a balance beam having wheels attached to its opposite ends. The balance beam supports a pair of caliper brakes for respectively engaging the wheels and a pair of brake levers of the type generally used for bicycle brake systems. The beam is intended to be carried like a balance beam while skating and placed on the ground for breaking momentum by squeezing a brake lever to retard the rotation of a wheel on the skating surface when stopping is required. The problem with the beam is that it appears to be expensive to manufacture and to maintain. A further problem is that a wheel surface provides very little frictional area for contacting the skating surface to facilitate stopping.

SUMMARY OF THE INVENTION

It is an object of the invention to provide a stabilizer beam for a roller blade skater which is simple to manufacture and inexpensive to maintain.

It is a further object of the invention to provide a stabilizer beam for a roller blade skater which permits the skater to configure the beam to accommodate the skill and activity of the skater.

It is yet a further object of the invention to provide a stabilizer beam for a roller blade skater which permits a skater to stop reliably in a short distance.

It is yet a further object of the invention to provide a stabilizer beam for a roller blade skater which contributes to the safety of roller blade skating.

The invention provides a stabilizer beam for a roller blade skater, comprising an elongated beam having a first end and a second end, and at least three gripping regions disposed in spaced apart relation between the first end and the second end;

the first end being adapted to detachably retain a brake pad for selective frictional engagement with a surface suitable for roller blade skating to permit the roller blade skater to selectively break a momentum of movement by forcing the brake pad into braking contact with the surface; and the second end being adapted to detachably retain an insert for supporting an implement useful for stabilizing the roller blade skater on the roller blades, whereby the implement can be changed to accommodate the skill and the activity of the roller blade skater.

The invention therefore provides a simple stabilizer beam having a minimum of moving parts, the stabilizer beam being particularly useful in breaking the momentum of a roller blade skater as well as improving body control during freewheel skating. The invention also provides a beam which is adaptable to the skill and/or activity of the skater. One end of the beam supports a brake pad for breaking the momentum of the skater while the opposite end supports one of at least three interchangeable inserts which include a brake pad, a free turning wheel, and a hockey stick blade. Each insert is supported on a shaft which preferably includes a plurality of spaced apart holes for adjustably attaching the insert to the beam. This permits adjustment of the length of the beam to accommodate the skater's preferences.

A preferred embodiment of the beam also includes a hollow compartment located behind the insert on the second end. The hollow compartment may optionally house a small cylindrical container. The compartment is used for storing spare parts and/or any other small articles to be carried with the beam.

BRIEF DESCRIPTION OF THE DRAWINGS

The invention will now be explained by way of example only and with reference to the following drawings wherein.

DETAILED DESCRIPTION OF THE PREFERRED EMBODIMENT

Figure 1:
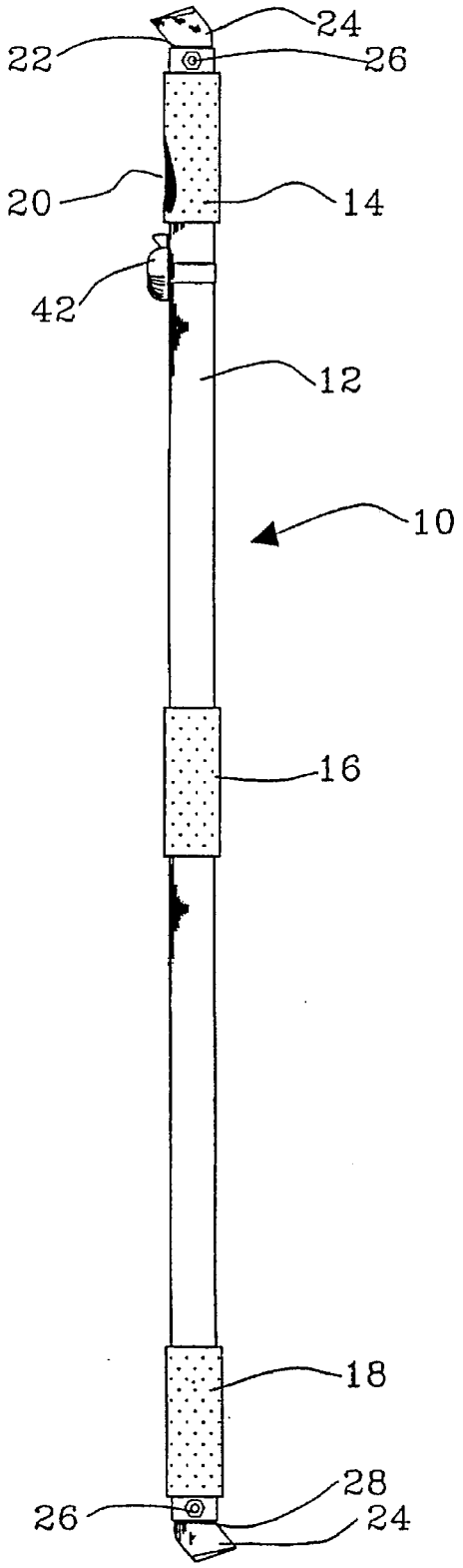
FIG. 1 is an elevational view of one configuration of a stabilizer beam for roller blade skaters in accordance with the invention.

FIG. 1 shows an elevational view of a preferred embodiment of a stabilizer beam 10 for a roller blade skater. The beam is preferably constructed from a hollow tube 12 which is preferably about 1.5" (2.8 cm) in diameter and about 4' (120 cm) in length. The actual length of the tube 12 will depend on the height of the skater. In general, the tube preferably extends from the ground to a point midway between the elbow and the shoulder of the skater. The tube 12 is preferably an aluminum tube although certain plastic and fiberglass compositions are also suitable materials. The tube 12 is preferably coated with a bright, reflective surface that is highly visible in order to attract attention to the skater to promote safety.

The stabilizer beam 10 is provided with three gripping regions, a top grip 14, a center grip 16 and a bottom grip 18. Each grip is preferably manufactured from a tough resilient material such as an open-celled foam commonly used for bicycle handlebar grips, and the like. The top grip is preferably provided with at least an indentation 20 for locating a thumb of the skater, for reasons which will be explained in more detail with reference to FIGS. 4 and 5. Attached to a first end of the pole 22 is a brake pad 24 molded from a resilient plastic material which provides good braking friction, such as the plastic used in the heel pads for roller blade skates. The removable brake pad is secured using a bolt and lock nut arrangement 26 such as those used for securing the wheels to roller blade skate frames.

A second end 28 of the stabilizer beam 10 is adapted to secure an interchangeable insert for supporting an implement which may be changed to accommodate the skill and/or activity of the roller blade skater using the stabilizer beam 10. The implement shown in FIG. 2 is a brake pad 24, preferred for beginning skaters as will be explained in relation to FIG. 4.

The stabilizer beam 10 also preferably includes an auditory signal device, such as a miniature bell 42, which is commercially available. The bell 42 permits a skater to announce his presence at blind comers and the like.

Figure 2:
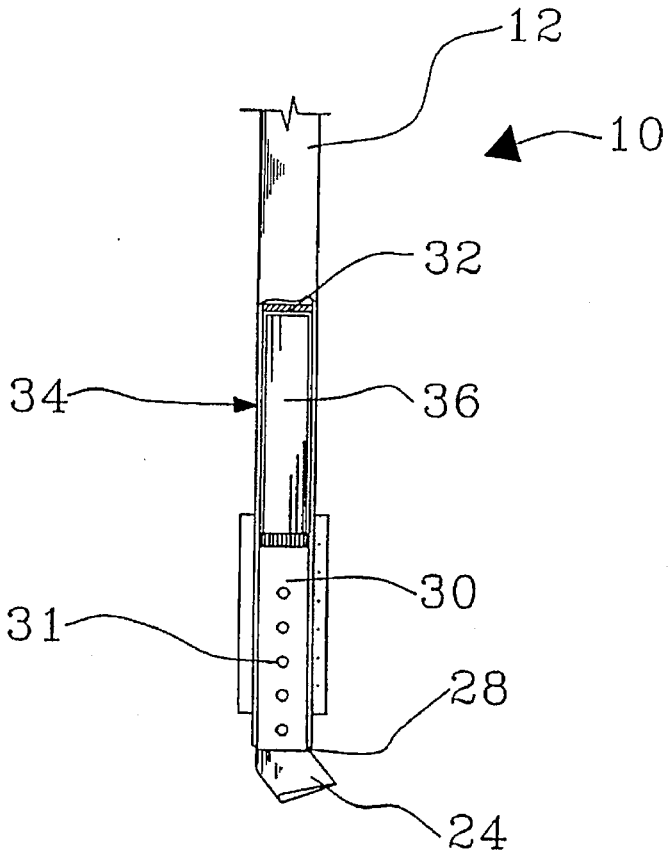
FIG. 2 is a partially cutaway view of a second end of the stabilizer beam shown in FIG. 1.

FIG. 2 shows a partially cutaway view of the second end 28 of the stabilizer beam 10. The second end 28 is hollow and receives a round shaft 30 which serves as an insert for supporting an implement such as a brake pad 24 for stabilizing the roller blade skater on his roller blades. The shaft 30 preferably includes a plurality of spaced apart holes 31 so that the length of the stabilizer beam 10 can be adjusted by selecting an appropriate hole 31 in the shaft 30. The shaft 30 is secured in position using a bolt and lock nut arrangement 26 (see FIG. 1).

In accordance with a preferred embodiment of the invention, there is a partition 32 which seals the hollow tube 12 to provide a storage chamber 34 defined at a top end by the partition 32 and at a bottom end by a top end of the shaft 30. The storage chamber 34 provides a convenient compartment for storing spare parts such as bolts and lock nuts 26, or any other small articles which are usefully carried with the stabilizer beam 10. The storage chamber 34 may optionally include a small cylindrical container 36 which is preferably sized to fit slidably within the storage chamber 34 so that it may be selectively inserted and removed but does not shift around in the storage chamber 34 when the stabilizer beam 10 is moved or rotated.

Figure 3A:
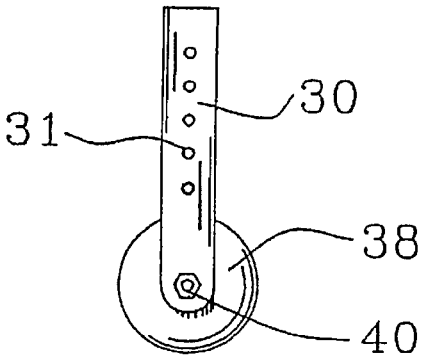
FIG. 3*a* is an elevational view of another optional implement for attachment to the stabilizer beam shown in FIG. 1.
Figure 3B:
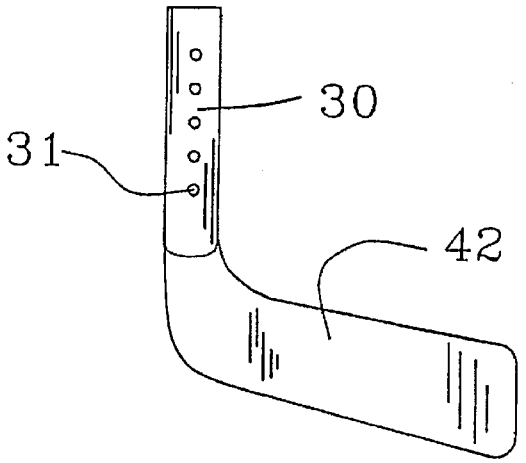
FIG. 3*b* is a perspective view of an optional implement for attachment to the stabilizer beam shown in FIG. 1.

FIG. 3*a* shows another implement for attachment to the second end 28 of the stabilizer beam 10. The implement includes a shaft 30 which is forked on its lower end and supports a wheel 38 which rotates freely on an axle 40. The wheel 38 is preferably a plastic wheel, such as a wheel for a roller blade skate. FIG. 3*b* shows a third implement, which is shaped like the blade 42 of a hockey stick to permit the stabilizer beam to be used for manipulating a ball or a puck while skating. The blade 42 is also preferably a molded plastic material.

Figure 4:
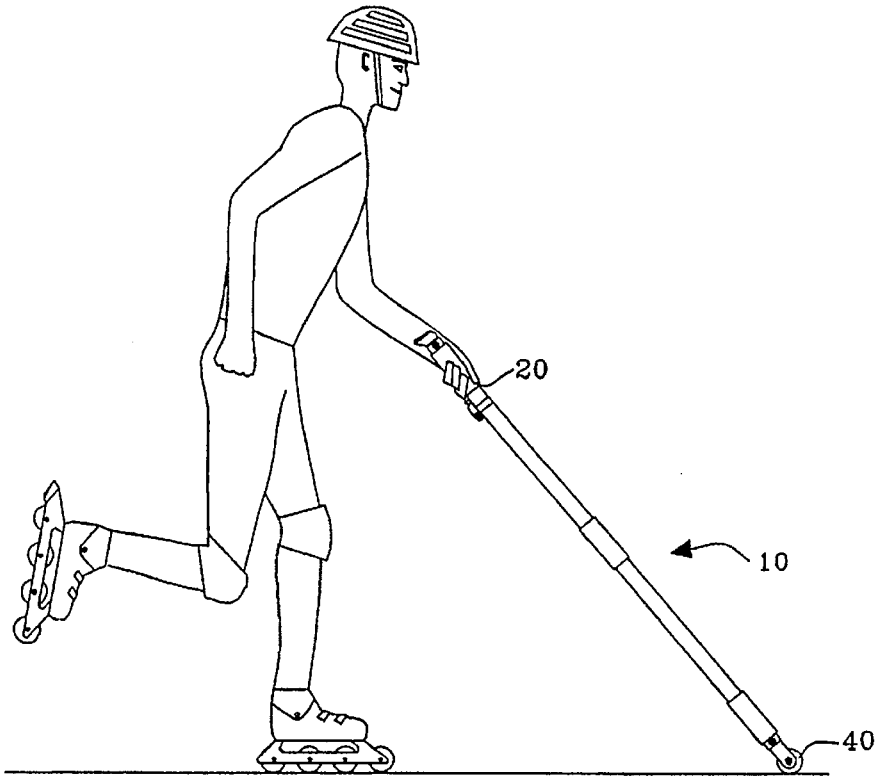
FIG. 4 is a perspective view of a skater freewheeling with the stabilizer beam in accordance with the invention.

FIG. 4 shows a skater using the stabilizer beam 10 while freewheel skating. The beam is equipped on its bottom end with a wheel 40. This configuration of the stabilizer beam 10 is preferred for experienced, agile skaters. The thumb indentation 20 (see FIG. 1) orients the stabilizer beam 10 in the skater's hand so that the wheel 40 is oriented in an upright position. This is important since a small diameter wheel such as the wheel 40 tends to cut to one side or the other if it is not correctly oriented. When correctly oriented, the wheel provides a stable, third balance point for the skater which permits the skater to shift his center of balance forward on the skates and achieve greater speed and forward momentum.

For beginning skaters, the second end 28 of the stabilizer beam 10 is preferably equipped with a second brake pad 24. The brake pad will readily slide over a skating surface if only light pressure is applied to the balance beam. If the skater begins to fall forward, however, the brake pad slows the momentum of the skater and assists the skater in staying up on their skates.

Skaters of any skill level occasionally enjoy skating with a blade 42 attached to the second end 28 to the stabilizer beam 10. The blade 42 permits the skater to manipulate a ball, a puck or the like while skating. The blade 42 is also useful for beginning skaters since it serves essentially the same function as the brake pad 24 for balancing and stopping the skater, even though it is preferably made of harder material and will not stop a skater as well as the brake pad.

Figure 5:
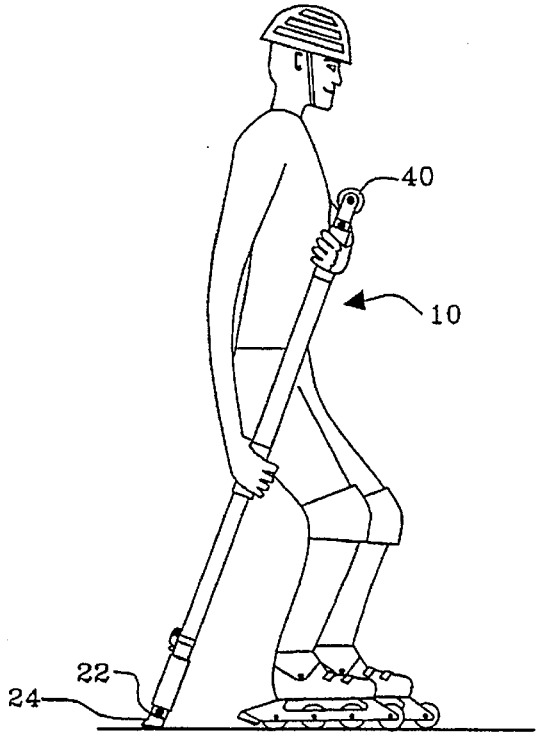
FIG. 5 is a perspective view of a skater shown in FIG. 4 using the stabilizer beam as a braking device.

FIG. 5 shows the stabilizer beam 10 being used as a braking device. Normally while braking, the beam is rotated 180° and the first end 22 is held downwards so that the bring pad 24 can be used to break momentum. If a brake pad 24 is installed on each of the first end 22 and the second 28 of the stabilizer beam 10, rotating the beam is not necessary. Braking is effected by levering the brake pad 24 against the skating surface. Considerable friction can be generated by shifting weight onto the stabilizer beam 10. This permits a skater to stop quickly and reliably without losing balance.

The stabilizer beam also permits skaters to make sharp turns safely. This may be accomplished using at least two techniques. A first method involves placing the wheel 38 on the skating surface in front of the skater, and the skater pivots around the stabilizer beam 10 while canting the wheel 38 in the direction of turn and shifting weight onto the stabilizer beam to force the wheel 38 against the skating surface. A second method involves assuming the braking position shown in FIG. 5 and pivoting around the stabilizer beam 10 while forcing the brake pad 24 against the skating surface and tilting the skates into a sharp turn.

The stabilizer beam in accordance with the invention therefore provides a new and useful accessory for roller blade skaters which contributes to the safety and enjoyment of the sport.

The embodiment of the invention described above is intended to be exemplary only, the scope of the invention being limited solely by the scope of the appended claims.

I claim:

1. A stabilizer beam for a roller blade skater, comprising:

an elongated beam having a first end and a second end, and hand gripping regions disposed in spaced apart relation along the beam, a first and second of the gripping regions being located at opposite ends of the beam;

the first end being adapted to detachably retain a brake pad for selective frictional engagement with a surface suitable for roller blade skating to permit the roller blade skater to selectively break a momentum of movement by forcing the brake pad into braking contact with the surface;

the second end being adapted to detachably retain an insert for supporting an implement useful for stabilizing the roller blade skater on the roller blades, the insert including an elongated shaft adapted to be received in the second end of the beam, the shaft including a plurality of spaced apart bores so that the length of the stabilizer beam can be adjusted, whereby the implement can be changed to accommodate the skill and the activity of the roller blade skater, and the length of the beam can be adjusted to accord with the preferences of the roller blade skater; and at least one of the gripping regions including a thumb indentation for aligning the beam to a predetermined rotational position relative to the skater's hand, thereby aligning at least one of said brake pad and said implement in an operative position for ground engagement.

2. A stabilizer beam for a roller blade skater as claimed in claim 1 wherein the implement is a second brake pad for selective frictional engagement with a surface suitable for roller blade skating to permit the roller blade skater to selectively brake a momentum and to provide a stabilizing support when braking is not required.

3. A stabilizer beam for a roller blade skater as claimed in claim 1 wherein the implement is a wheel that is freely rotatable at an end of the insert, the wheel providing a stabilizing support which is freely movable with the skater, whereby the wheel may be used to promote tight turning while skating on the roller blades and promote body control while free wheel skating on the roller blades.

4. A stabilizer beam for a roller blade skater as claimed in claim 1 wherein the implement is a blade shaped like a blade of a hockey stick to permit the roller blade skater to manipulate a ball or a puck while skating.

5. A stabilizer beam for a roller blade skater as claimed in claim 1 wherein the beam further includes a compartment within the beam, the compartment being closed by the insert, whereby the beam affords a concealed storage space for storing small articles.

6. A stabilizer beam for a roller blade skater as claimed in claim 5 wherein the beam further includes a cylindrical container which fits within the compartment for containing small articles to be stored in the concealed storage space.

7. A stabilizer beam for a roller blade skater as claimed in claim 6 wherein the container is sized to fit slidably within the compartment so that it may be selectively inserted and removed but does not shift around in the compartment when the beam is moved or rotated.

8. A stabilizer beam for a roller blade skater as claimed in claim 1 wherein the stabilizer beam further includes an auditory signal device.

9. A stabilizer beam for a roller blade skater as claimed in claim 8 wherein the auditory signal device is a miniature bell which provides an auditory signal on demand.

10. A stabilizer beam for a roller blade skater, comprising in combination:

an elongated beam having a first end and a second end, and a hand a gripping region disposed at each of the first end and the second end;

the first and second ends being adapted to detachably retain an insert, the insert including an elongated shaft adapted to be received in one end of the beam, the shaft including a plurality of spaced apart bores so that the length of the stabilizer beam can be adjusted;

at least two inserts selected from a group comprising a brake pad for selective frictional engagement with a surface suitable for roller blade skating to permit the roller blade skater to selectively break a momentum of movement by forcing the brake pad into braking contact with the surface; a wheel that is freely rotatable at an end of the insert, the wheel providing a stabilizing support which is freely movable with a skater; and a blade shaped like a blade of a hockey stick to permit the roller blade skater to manipulate a ball or puck while skating; and at least one of the gripping regions including thumb indentation for aligning the beam to a predetermined rotational position relative to the skater's hand, thereby aligning at least one of said inserts in an operative position for ground engagement.

11. A stabilizer beam for a roller blade skater, comprising in combination:

an elongated beam having a first end and a second end, first and second grips disposed respectively at distally opposite ends of said beam at each of the first end and the second end thereof and a third grip disposed on said beam intermediate said first and second grips;

the first and second ends being adapted to detachably retain an insert, the insert including a functional element useful by a roller blade skater in roller blade skating mounted to the stabilizer beam by an elongated shaft adapted to be received in one end of the beam, the shaft including a plurality of spaced apart bores so that the length of the stabilizer beam can be adjusted;

at least two inserts selected from a group comprising a brake pad for selective frictional engagement with a surface suitable for roller blade skating to permit the roller blade skater to selectively break a momentum of movement by forcing the brake pad into braking contact with the surface; a wheel that is freely rotatable at an end of the insert, the wheel providing a stabilizing support which is freely movable with a skater; and a blade shaped like a blade of a hockey stick to permit the roller blade skater to manipulate a ball or puck while skating;

said first grip and said third grip being engaged by the roller blade skater when said second element at said second end of said beam is in use, and said second grip and said third grip being engaged by the roller blade skater when said first element at said first end of said beam is in use; and at least one of said first and second grips including a thumb indentation for aligning the beam in a direction extending forwardly from the skater, thereby aligning at least one of said inserts in an operative position for ground engagement.

* * * * *